US007350469B2

(12) United States Patent
Koning et al.

(10) Patent No.: US 7,350,469 B2
(45) Date of Patent: Apr. 1, 2008

(54) FOLDING LEG LATCH ASSEMBLY

(76) Inventors: Paul Koning, 6434 Oakridge Dr., Holland, MI (US) 49423; Matthew Ruster, 10866 Brees Way, Holland, MI (US) 49423; Jack Nyenhuis, 1441 Broadview, Jenison, MI (US) 49428

( * ) Notice: Subject to any disclaimer, the term of this patent is extended or adjusted under 35 U.S.C. 154(b) by 452 days.

(21) Appl. No.: 10/833,251

(22) Filed: Apr. 27, 2004

(65) Prior Publication Data

US 2005/0235886 A1 Oct. 27, 2005

(51) Int. Cl.
*A47B 3/00* (2006.01)

(52) U.S. Cl. ..... 108/132; 108/115

(58) Field of Classification Search ..... 108/115–133; 248/188, 188.1, 188.6, 166, 188.8, 167, 439; 292/137, 161, 163, 165, 173, 32, 40
See application file for complete search history.

(56) References Cited

U.S. PATENT DOCUMENTS

| | | | | | |
|---|---|---|---|---|---|
| 203,649 | A | | 5/1878 | Runton et al. | |
| 268,533 | A | * | 12/1882 | Reed | 292/40 |
| 818,081 | A | * | 4/1906 | Dwyer | 16/326 |
| 1,188,839 | A | * | 6/1916 | Schell | 16/327 |
| 1,203,783 | A | * | 11/1916 | Reischmann | 108/132 |
| 3,707,862 | A | * | 1/1973 | Pastva, Jr. | 70/150 |
| 3,861,329 | A | * | 1/1975 | Kitchen, Sr. | 108/125 |
| 3,993,004 | A | | 11/1976 | Alme | |
| 4,838,181 | A | * | 6/1989 | Luyk | 108/156 |
| 4,986,195 | A | * | 1/1991 | Diffrient | 108/150 |
| 5,056,746 | A | * | 10/1991 | Parsons et al. | 248/188 |
| 5,121,697 | A | * | 6/1992 | Baum et al. | 108/124 |
| 5,279,233 | A | | 1/1994 | Cox | |
| 5,292,159 | A | * | 3/1994 | Sandhu et al. | 292/173 |
| 5,323,713 | A | * | 6/1994 | Luyk et al. | 108/131 |
| 5,353,715 | A | | 10/1994 | Luyk | |
| 5,354,027 | A | | 10/1994 | Cox | |
| 5,606,922 | A | | 3/1997 | Adams et al. | |
| 5,845,589 | A | * | 12/1998 | Pfister | 108/132 |
| 6,394,005 | B1 | * | 5/2002 | Isensee et al. | 108/132 |
| 6,845,723 | B2 | * | 1/2005 | Kottman et al. | 108/132 |
| 2003/0167980 | A1 | * | 9/2003 | Suzuki | 108/129 |

* cited by examiner

*Primary Examiner*—Janet M. Wilkens
*Assistant Examiner*—Timothy M Ayres
(74) *Attorney, Agent, or Firm*—Miller, Canfield, Paddock and Stone, P.L.C.; Robert K. Roth

(57) ABSTRACT

A latch assembly is disclosed comprising a handle pivotable from a first position to a second position, a slider movable in response to movement of the handle between the first position and the second position, and a pivot pivotable between an upright position and a foldable position, wherein when the handle is in the first position the pivot is locked in one of the upright position and the foldable position, and when the handle is moved to the second position the pivot is movable between the upright position and the foldable position.

2 Claims, 9 Drawing Sheets

FOLDING LEG LATCH ASSEMBLY

FIELD OF THE INVENTION

This invention relates to improvements in latch assemblies, and more particularly to improvements in latch assemblies used with tables having folding legs.

BACKGROUND OF THE INVENTION

Folding tables are widely used in corporate and institutional settings. Since they are foldable between an upright position and a foldable position, folding tables are particularly suitable in places where subject to frequent change, such as hotels and conference center meeting rooms. Tables in a folded position take up less space, reducing the area needed for storage. A latch assembly can be provided which locks the table in either the folded position or upright position. One problem that has been seen with folding tables is that the latch assembly is less rigid than desired. Such latch assemblies may be loose and subject to rattling and wobbling. Moreover, latch assemblies may not be rigidly secured at both the upright and folded positions. Further, access to the release mechanism allowing movement between the upright and folded positions may be limited.

It would be highly desirable to have a low cost latch assembly which is lockable in multiple positions, rigid, easy to access and which is locked at both an upright position and a folded position.

SUMMARY OF THE INVENTION

In accordance with a first aspect, a latch assembly comprises a handle pivotable from a first position to a second position, a slider movable in response to movement of the handle between the first position and the second position, and a pivot pivotable between an upright position and a foldable position, wherein when the handle is in the first position the pivot is locked in one of the upright position and the foldable position, and when the handle is moved to the second position the pivot is movable between the upright position and the foldable position.

From the foregoing disclosure and the following more detailed description of various preferred embodiments it will be apparent to those skilled in the art that the present invention provides a significant advance in the technology of latch assemblies. Particularly significant in this regard is the potential the invention affords for providing a high quality, low cost latch assembly. Additional features and advantages of various preferred embodiments will be better understood in view of the detailed description provided below.

Figure 1:
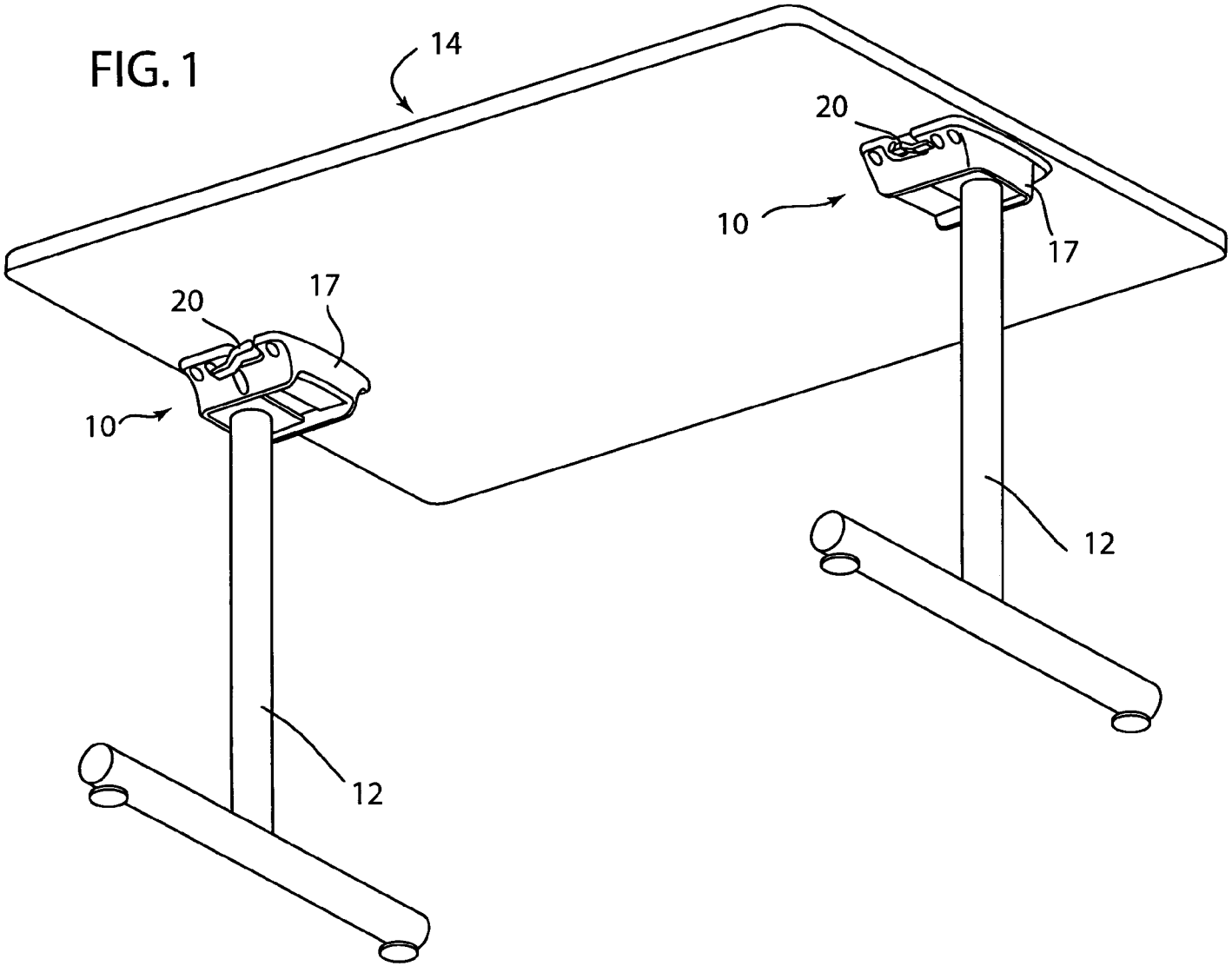
FIG. 1 is a perspective view of a table having a latch assembly in accordance with a preferred embodiment with legs shown in the upright position.

It should be understood that the appended drawings are not necessarily to scale, presenting a somewhat simplified representation of various preferred features illustrative of the basic principles of the invention. The specific design features of the latch assembly as disclosed here, including, for example, the specific dimensions of the handle, will be determined in part by the particular intended application and use environment. Certain features of the illustrated embodiments have been enlarged or distorted relative to others to enhance visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the latch assembly disclosed here. The following detailed discussion of various alternative and preferred features and embodiments will illustrate the general principles of the invention with reference to a latch assembly particularly suitable for use with a table having folding legs. Other embodiments suitable for other applications will be apparent to those skilled in the art given the benefit of this disclosure.

Figure 2:
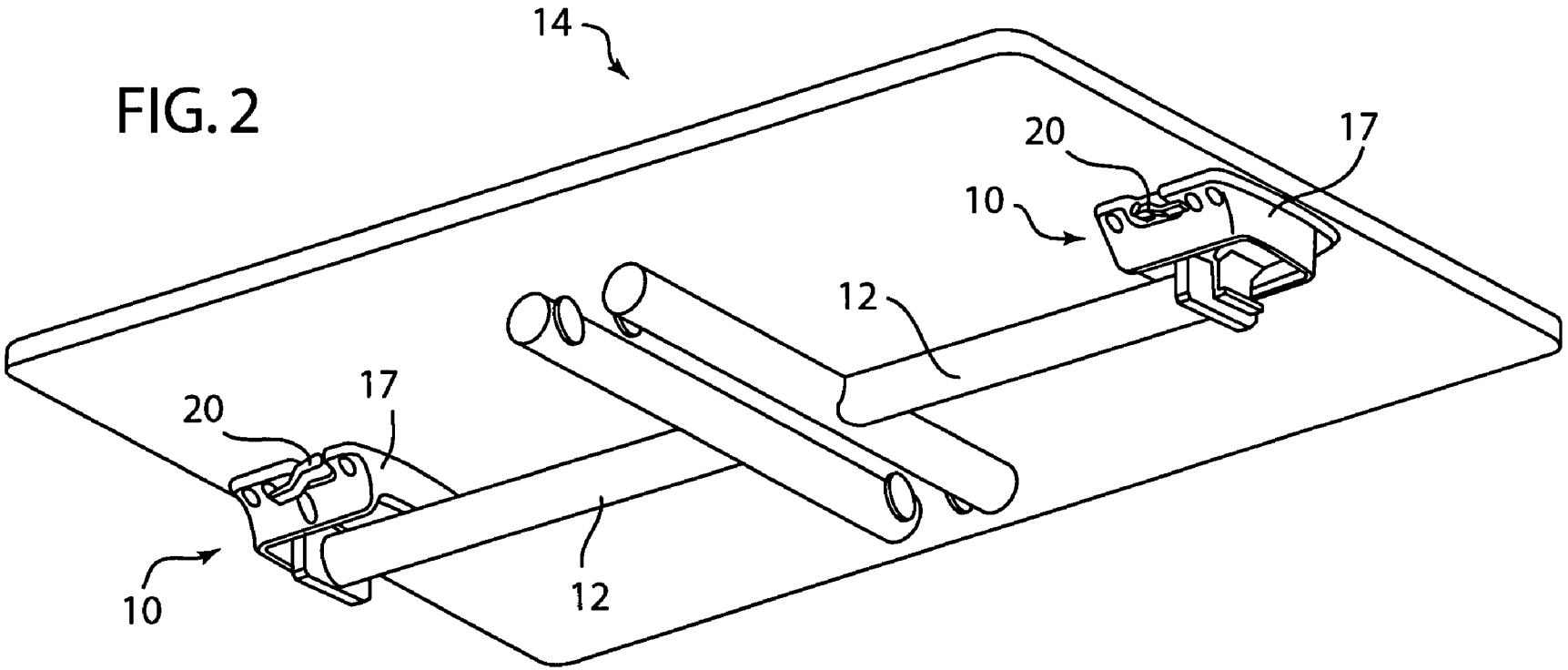
FIG. 2 is a perspective view of the table of FIG. 1 shown with the legs in the folded position.
Figure 3:
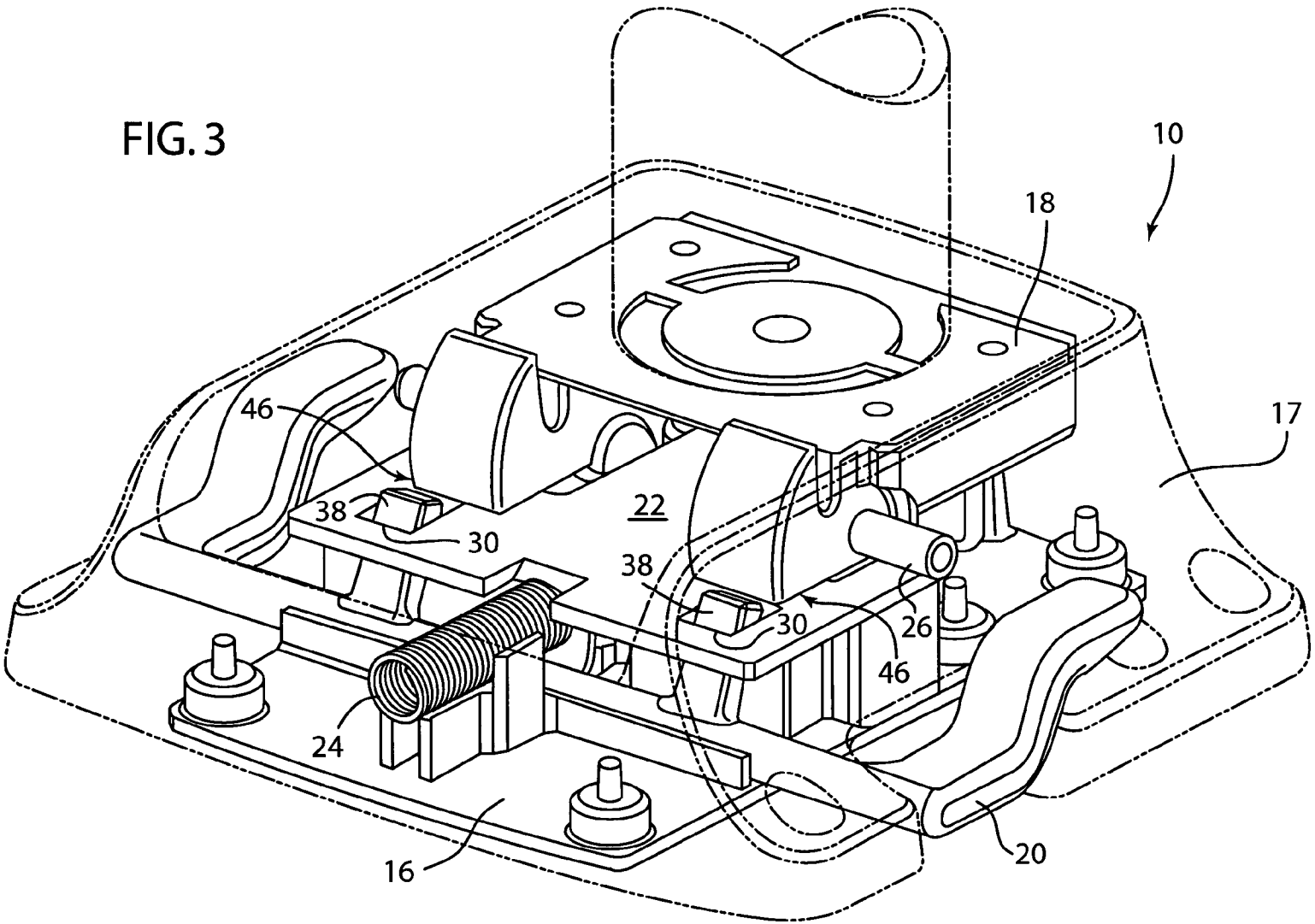
FIG. 3 is an isolated perspective view of the latch assembly shown from underneath the table, with a housing shown in phantom.
Figure 4:
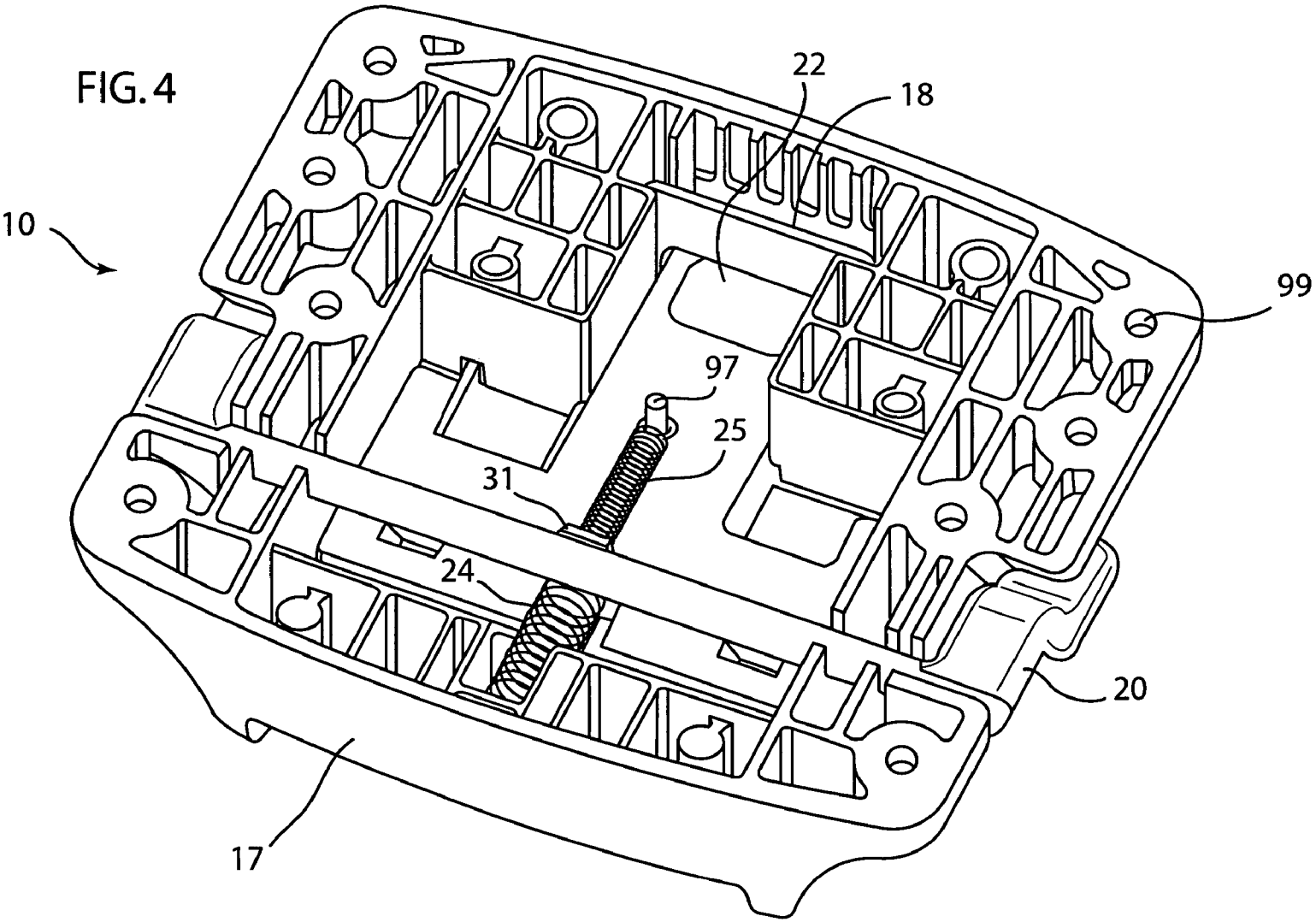
FIG. 4 is an isolated perspective view of the side of the latch assembly of FIG. 1 which would abut a table.

Referring now to the drawings, FIG. 1 shows a table 14 having a pair of legs 12 foldable from an upright position (as shown in FIG. 1) to a folded position (as shown in FIG. 2) where the legs fold toward each other. A preferred embodiment of a latch assembly 10 is shown which connects each leg 12 to the table 14. FIG. 3 shows a view of the underside of the latch assembly 10 which connects to a leg at pivot 18. The pivot 18 is shown in FIG. 3 in the upright position, generally corresponding to the upright position of the leg when attached. The pivot 18 is pivotably mounted on pins 26 on housing 17 (shown in phantom) and is pivotable on between the upright position (FIG. 3) and the folded position. Preferably the pivot 18 is releasably lockable at the upright position and at the folded position. The housing 17 and a cover 16 cooperate to form a housing assembly (preferably injection molded) and the various components of the latch assembly 10 are positioned within the housing assembly. For example, the handle 20 is captured between the housing 17 and the cover 16, and in a normal first position is biased against the cover 16. As described in greater detail below, movement of the handle can release the pivot 18, allowing the pivot to move between the folded and upright positions. Optionally the handle 20 extends past both sides of the housing, permitting easier access by a user. A slider 22 operatively connects the handle 20 to the pivot 18. As seen in FIG. 4, a spring, preferably a compression spring 24, is positioned between the housing 17 and a projection 31 on the slider, biasing the slider 22 away from the housing. Optionally, as shown in the drawings, a portion of the cover 16 may act as a support for the compression spring 24.

FIG. 4 shows the top side of the latch assembly 10 with the cover 16 removed. The top side would normally abut and be fixed to table 14 with fasteners 98 (shown in FIG. 5) through openings 99. An extension spring 25 is visible, anchored to a screw 97 or other suitable fastener. When an operator unlocks the pivot 18, he uses the handle 20 to overcome the force of the extension spring 25 and compression spring 24 and urge the handle from the first position to a second position.

Figure 5:
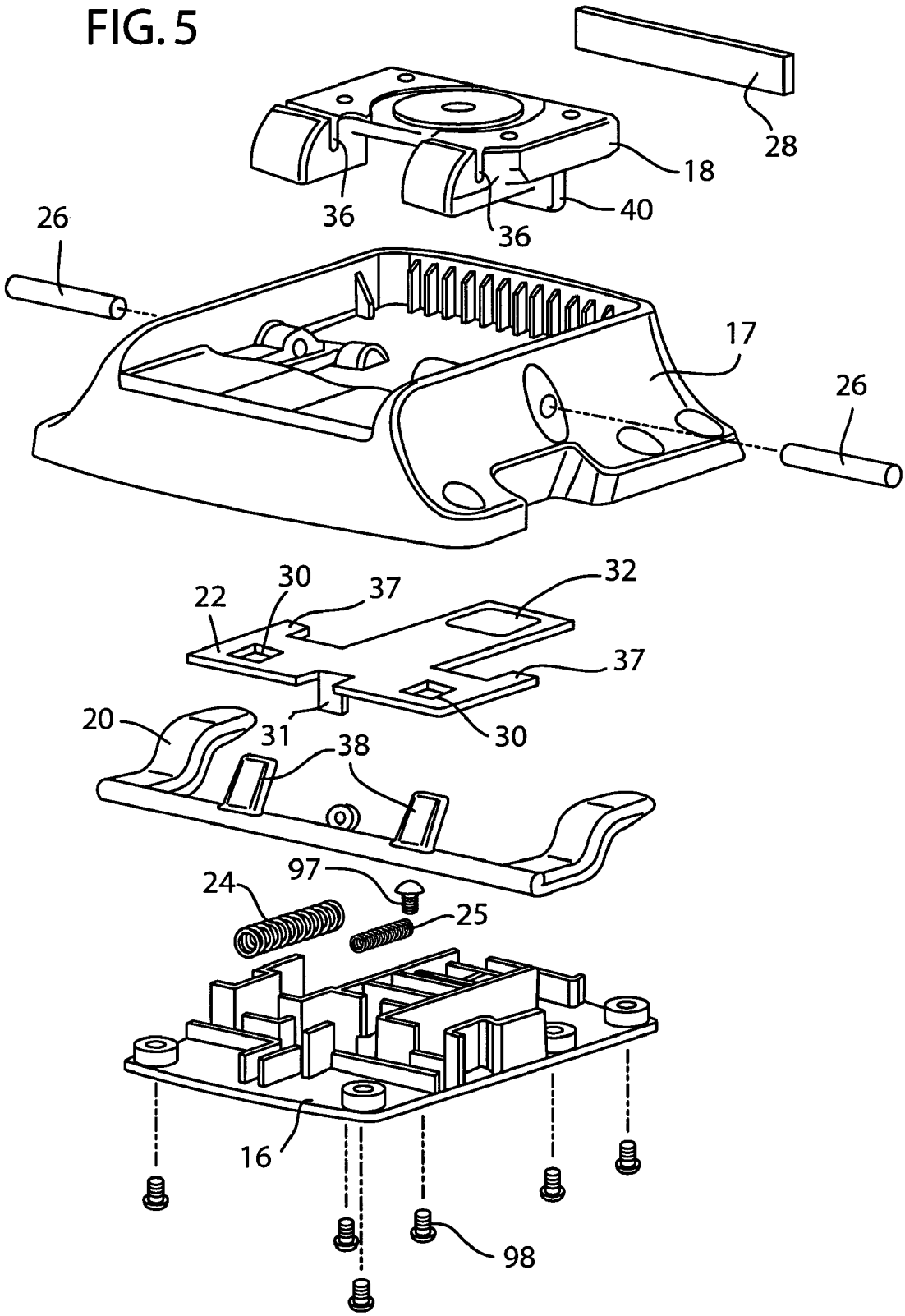
FIG. 5 is an exploded perspective view of the latch assembly of FIG. 1.

FIG. 5 shows an exploded perspective view of the handle 20, slider 22, pivot 18, housing 17 and cover 16, as well as the other components of the latch assembly 10. The pivot 18 is pivotably mounted on pivot pins 26 on housing 17. The folding leg 12 would be attached to the top visible surface of pivot 18 seen in FIG. 5. Folded position slots 36 are provided which engage corresponding wing projections 37 of the slider 22, as discussed in greater detail below. The slider 22 is slidable between the cover and the housing, has a tapered end 32, wing projections 37, openings 30 which engage corresponding projections 38 on the handle 20, and a projection 31 generally centrally positioned which engages the compression spring 24.

Figure 6:
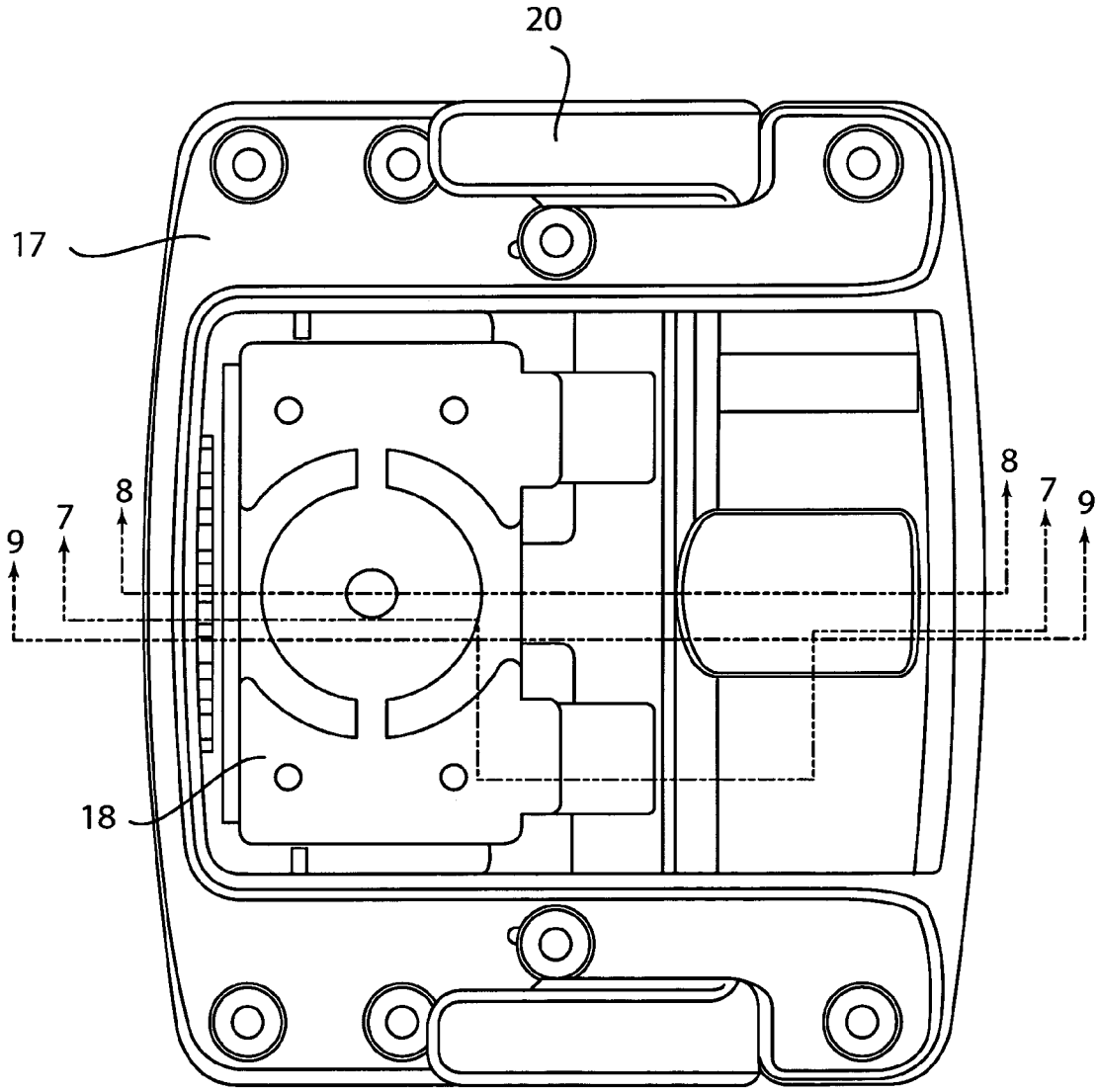
FIG. 6 is a side view looking up toward the side of the latch assembly which engages a leg.
Figure 7:
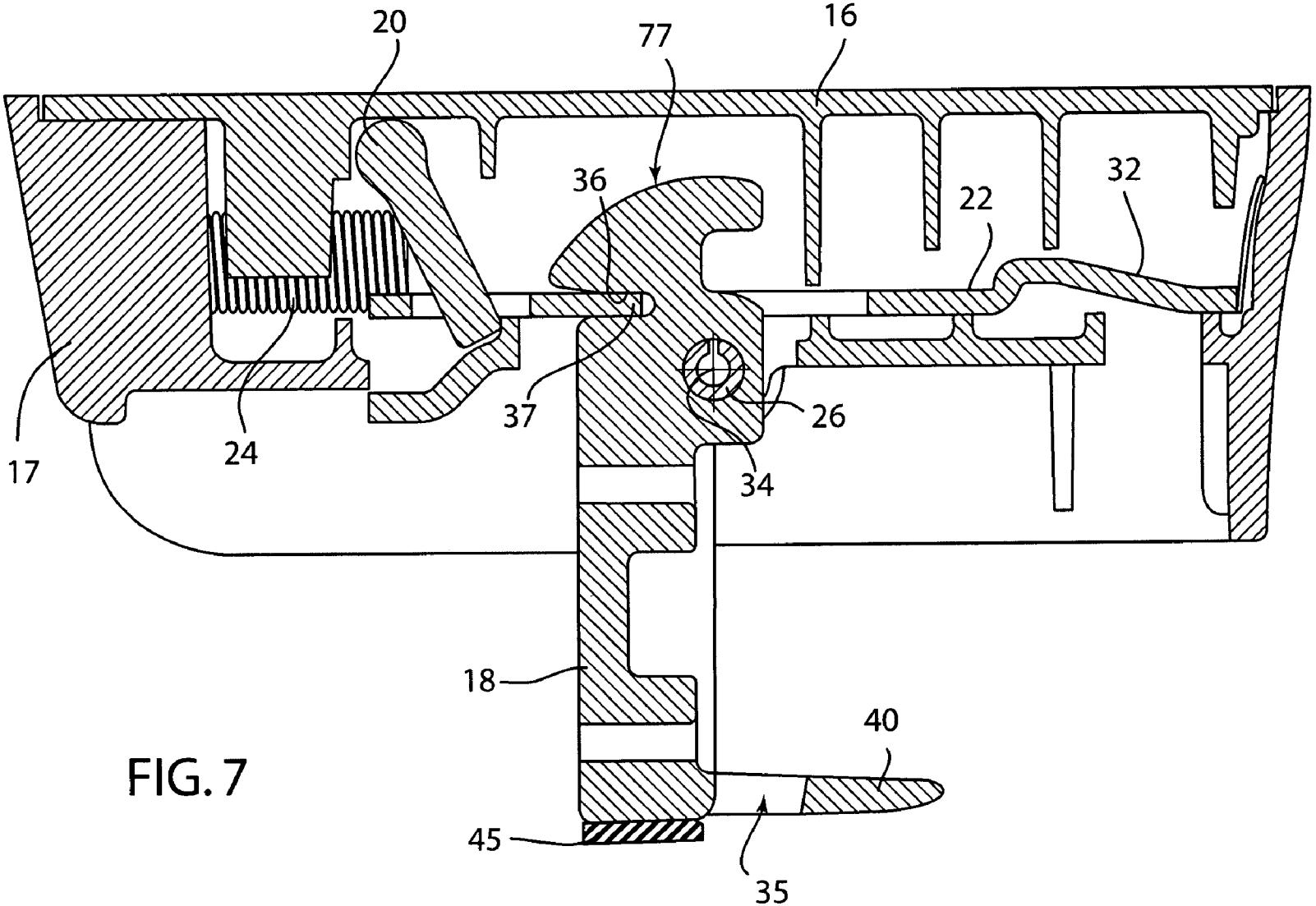
FIG. 7 is a cross section view taken through line 7-7 in FIG. 6 when the leg is in the folded position.
Figure 8:
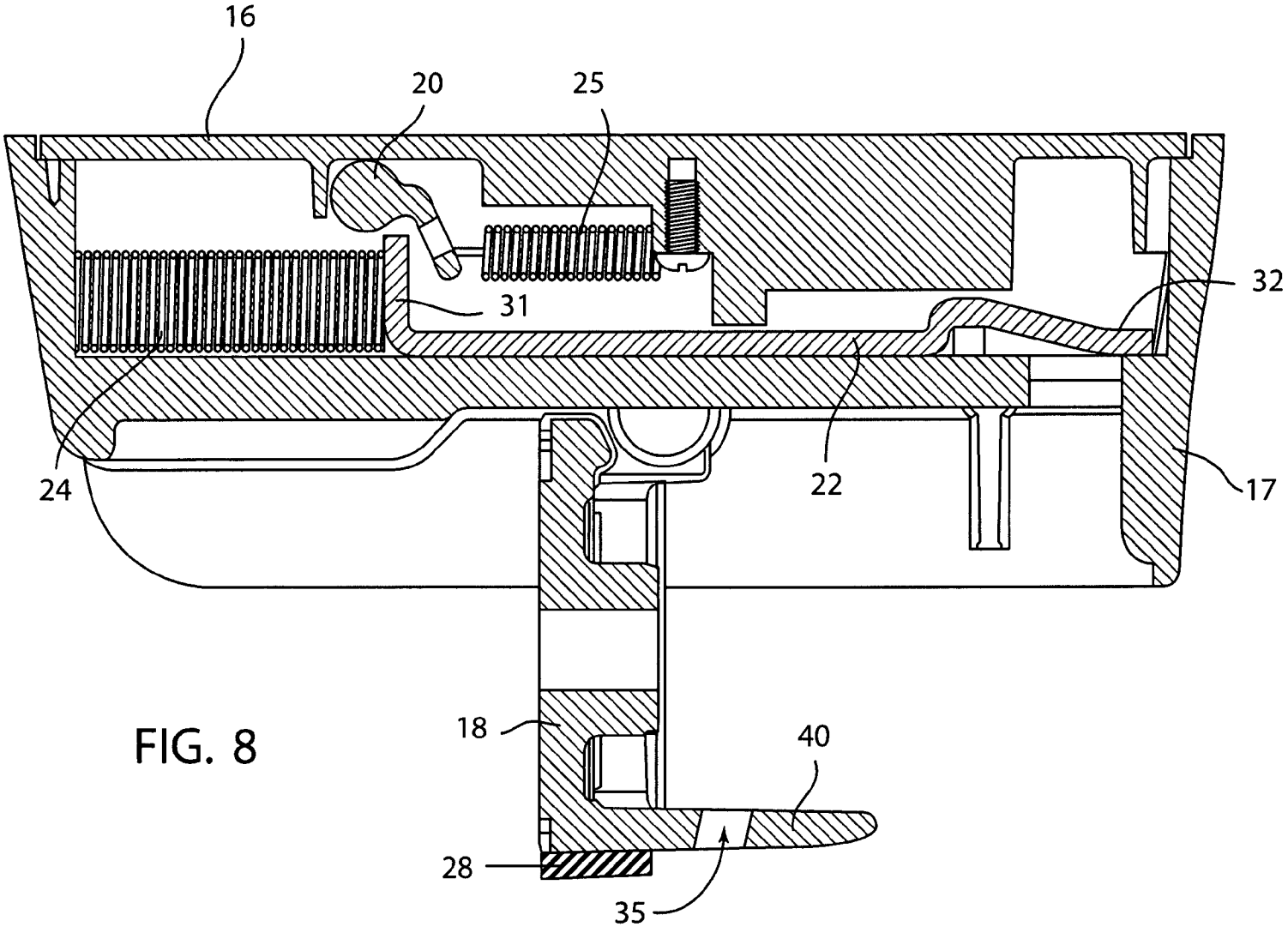
FIG. 8 is a cross section view taken through line 8-8 in FIG. 6 when the leg is in the folded position.
Figure 9:
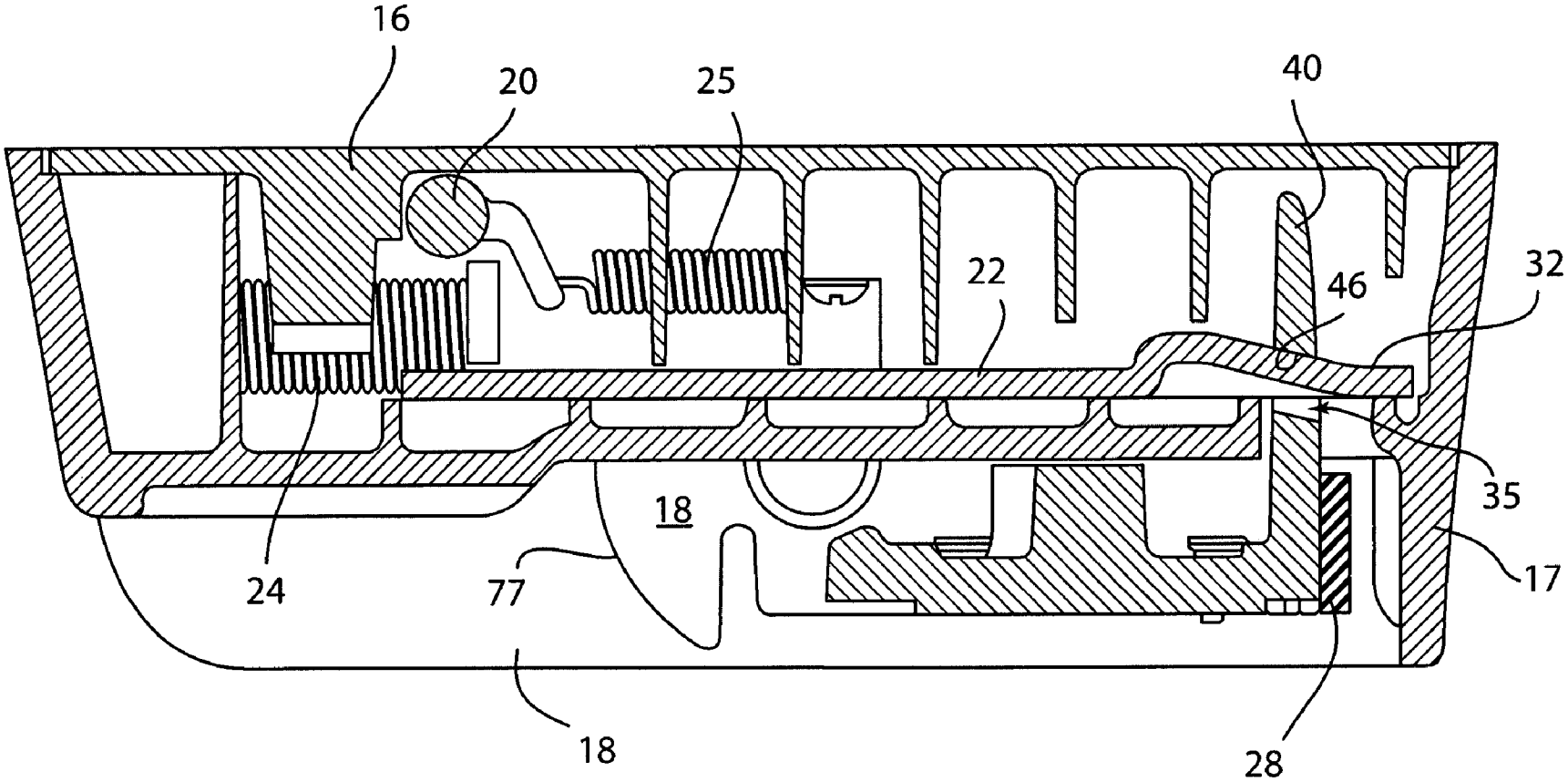
FIG. 9 is a cross section view taken though line 9-9 in FIG. 6 when the leg is in the upright position.

FIG. 6 is a side view looking up at the latch assembly. The pivot 18 is readily attachable to the legs of the table, and the handle 20, normally biased in the first position as shown, can be moved to the second position by moving either flange extending from either side of the housing assembly as seen in FIG. 6. FIG. 7 is a cross section view of FIG. 6 taken along line 6-6, showing the pivot 18 in the upright position. The folded position slot 36 in the pivot is clearly visible. FIG. 8 is a cross section view taken along line 7-7 in FIG. 6, showing the pivot 18 in the folded position, and FIG. 9 is another cross section view in the folded position, taken along line 8-8 in FIG. 6. These three cross section views help show the relative position of the various components of the latch assembly during operation.

FIGS. 7 and 8 show the pivot 18 in the folded position. The handle 20 is pulled by the extension spring 25 to the first position and the compression spring 24 biases the projection 31 of slider 22, locking the pivot in the folded position. (FIG. 8). Optionally a rubber pad 28 may be provided near the pivot flange 40. The purpose of the rubber pad is to provide cushioning when tables using such latch assemblies are stacked together.

Thus, operation of the handle 20 causes the handle projections 38 to urge the slider 22 to translate so that the tapered end 32 disengages the tapered slot 35 in the pivot flange 40. This frees the pivot 18 to pivot from the upright position to the folded position. Preferably the pivot 18 has a curved surface 77 which guides the wing projections 37 of the slider to enter the folded position slot 36 as the pivot moves to the folded position. Release of the handle from the second position urges the handle to return to the first position. However, the handle cannot do so until the slider is free to move again. This occurs once the slider projections 37 have entered the folded position slot 36. The projections 37 cooperate with the cover to hold the pivot in the folded position.

In FIG. 9, the pivot 18 is in the upright position and the handle 20 is in the first position. In accordance with a highly advantageous feature, the slider 22 extends past either side of the pivot axis and restricts movement of the pivot on both sides, locking the pivot in the upright position. An under pivot segment 46 (also shown in FIG. 3) prevents clockwise rotation of the pivot (with respect to the view in FIG. 9) and a tapered end 32 of the slider engages a tapered slot 35 in a pivot flange 40, restricting counterclockwise movement (with respect to the view in FIG. 9). Advantageously, the tapered end 32 allows for variation and tolerance differences of multiple components while still maintaining a rigid lock of the pivot in the upright position.

The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A table and a leg to support the table in combination with a leg latch assembly, the combination comprising:

a housing assembly comprising a housing mounted to the bottom of the table and a cover attached to the housing; a pivot pivotably mounted to the housing and rotatable with respect to the housing between an upright position and a foldable position, wherein the pivot defines an upright slot and a folded position slot; the leg is attached to the pivot and the leg is pivotable with respect to the table via the pivot;

a handle pivotable with respect to the housing assembly from a first position to a second position, wherein the handle is at least partially positioned outside the housing assembly;

a slider which slides linearly in the housing in response to rotation of the handle between the first position and the second position the slider having a tapered end and a wing projection, wherein the handle has at least one projection engaging a corresponding opening in the slider so that rotation of the handle urges the slider to slide;

wherein when the handle is in the first position the pivot is locked with respect to the table in the upright position when the tapered end wedges against the pivot at the upright slot, and is in the foldable position when the wing projection engages the pivot at the folded position slot, and when the handle is moved to the second position the pivot is rotatable with respect to the table between the upright position and the foldable position.

2. The latch assembly of claim 1 further comprising a compression spring biasing the slider into engagement with the pivot and an extension spring biasing the handle toward the first position.

* * * * *